US010907359B2

(12) United States Patent
Kenny

(10) Patent No.: US 10,907,359 B2
(45) Date of Patent: Feb. 2, 2021

(54) EXTRUDED ALUMINUM CANOPY WITH HIDDEN FASTENERS

(71) Applicant: Jeffrey S. Kenny, Fort Worth, TX (US)

(72) Inventor: Jeffrey S. Kenny, Fort Worth, TX (US)

( * ) Notice: Subject to any disclaimer, the term of this patent is extended or adjusted under 35 U.S.C. 154(b) by 116 days.

(21) Appl. No.: 15/986,275

(22) Filed: May 22, 2018

(65) Prior Publication Data

US 2018/0266117 A1 Sep. 20, 2018

Related U.S. Application Data

(62) Division of application No. 14/975,014, filed on Dec. 18, 2015, now Pat. No. 9,976,310.

(51) Int. Cl.
*E04F 10/00* (2006.01)

(52) U.S. Cl.
CPC ..... *E04F 10/005* (2013.01)

(58) Field of Classification Search
CPC ..... E04F 10/00; E04F 10/005; E04F 10/08; E04F 10/10; E04B 1/003; E04B 1/0038; E04B 1/3416; E04B 1/34; E04B 1/342; F16S 1/02; F16S 3/02; F16S 3/04; F16S 3/06; F16S 3/08; F16B 37/044; F16B 37/045

See application file for complete search history.

(56) References Cited

U.S. PATENT DOCUMENTS 2,701,397 A 2/1955 Perry
2,762,089 A * 9/1956 Auble ..... E04F 10/08 52/11
3,113,434 A * 12/1963 Phillips ..... E04C 2/384 52/11
3,375,029 A * 3/1968 Frye ..... B62D 33/044 403/230
3,388,510 A * 6/1968 Smith ..... E04F 10/08 52/15
3,524,289 A 8/1970 Yazejian
3,533,587 A * 10/1970 Smith ..... F16B 9/02 248/228.5
4,100,703 A 7/1978 Sickler
5,116,161 A * 5/1992 Faisst ..... E04B 2/76 403/231
5,483,773 A 1/1996 Parisien
5,564,579 A 10/1996 Pynenburg et al.
8,104,527 B1 1/2012 Konda et al.
8,683,752 B1 4/2014 Gonzalez
8,739,473 B2 6/2014 Michel et al.
(Continued)

FOREIGN PATENT DOCUMENTS

FR 2587067 A1 * 3/1987 ..... F16B 5/02

OTHER PUBLICATIONS

Machine translation of FR25870674 (ip.com) (Year: 2019).*
Restriction Requirement from corresponding U.S. Appl. No. 14/975,014.
Office Action from corresponding U.S. Appl. No. 14/975,014.
Notice of Allowance from corresponding U.S. Appl. No. 14/975,014.
(Continued)

*Primary Examiner* — Jessica L Laux
(74) *Attorney, Agent, or Firm* — James E. Walton

(57) ABSTRACT

A system and method for fabricating canopies featuring extruded members coupled together with fasteners that are hidden and are retained by multiple tracks located in the extruded members. Prefabricated corners of extruded members allow fabricators to build the canopy on site by attaching straight members to form a canopy from the four prefabricated corners.

19 Claims, 7 Drawing Sheets

(56) References Cited

U.S. PATENT DOCUMENTS

| | | | | |
|---|---|---|---|---|
| 9,328,516 | B2 * | 5/2016 | Albert | E04F 10/005 |
| 2004/0049993 | A1 | 3/2004 | Saldana | |
| 2005/0188903 | A1 * | 9/2005 | Ryberg | A47B 96/024 108/149 |
| 2006/0180702 | A1 * | 8/2006 | Pfeifer | B65H 75/10 242/609.1 |
| 2010/0126081 | A1 * | 5/2010 | Michel | E04F 10/005 52/74 |
| 2011/0302871 | A1 * | 12/2011 | Michel | E04F 10/005 52/653.2 |
| 2013/0140416 | A1 * | 6/2013 | West | F16B 1/00 248/222.11 |
| 2015/0052712 | A1 * | 2/2015 | Markiewicz | H02S 20/00 24/569 |
| 2015/0101260 | A1 * | 4/2015 | Albert | E04F 10/005 52/15 |

OTHER PUBLICATIONS

Restriction Response from corresponding U.S. Appl. No. 14/975,014.
Amendment from corresponding U.S. Appl. No. 14/975,014.
Amendment and RCE from corresponding U.S. Appl. No. 14/975,014.
Office Acton dated Oct. 28, 2019 from related U.S. Appl. No. 15/986,334.
Amendment dated Jan. 28, 2020 from related U.S. Appl. No. 15/986,334.
Final Office Action dated Mar. 2, 2020 from related U.S. Appl. No. 15/986,334.
Amendment After Final dated Apr. 23, 2020 from related U.S. Appl. No. 15/986,334.
Advisory Action dated May 19, 2020 from related U.S. Appl. No. 15/986,334.
Issue Notification dated May 4, 2018 for related U.S. Appl. No. 14/975,014.

* cited by examiner

EXTRUDED ALUMINUM CANOPY WITH HIDDEN FASTENERS

BACKGROUND

1. Field of the Invention

The present invention relates generally to canopies, and more specifically to a system and method for canopies that feature hidden fasteners.

2. Description of Related Art

Canopies are structures that provide shade and protection from rain. Canopies are typically affixed to the sides of buildings near doors for shelter. Canopies are also used for aesthetic purposes to decorate buildings. Conventional canopies are assembled and welded together at the shop. After welding, the canopy is sanded and then painted or finished. The canopy is then shipped to the building and hoisted up to be secured to the building. Thus conventional canopies are size limited by the ability to fabricate them and move them in one-piece to the jobsite. Additionally a large canopy is difficult to hoist due to the weight and size. Furthermore, the one piece canopy cannot be resized at the jobsite as the assembly is welded together preventing on site job adjustment. Thus, there exists significant room for improvement in the art for overcoming these and other shortcomings of conventional systems and methods for canopies attached to the side of buildings.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
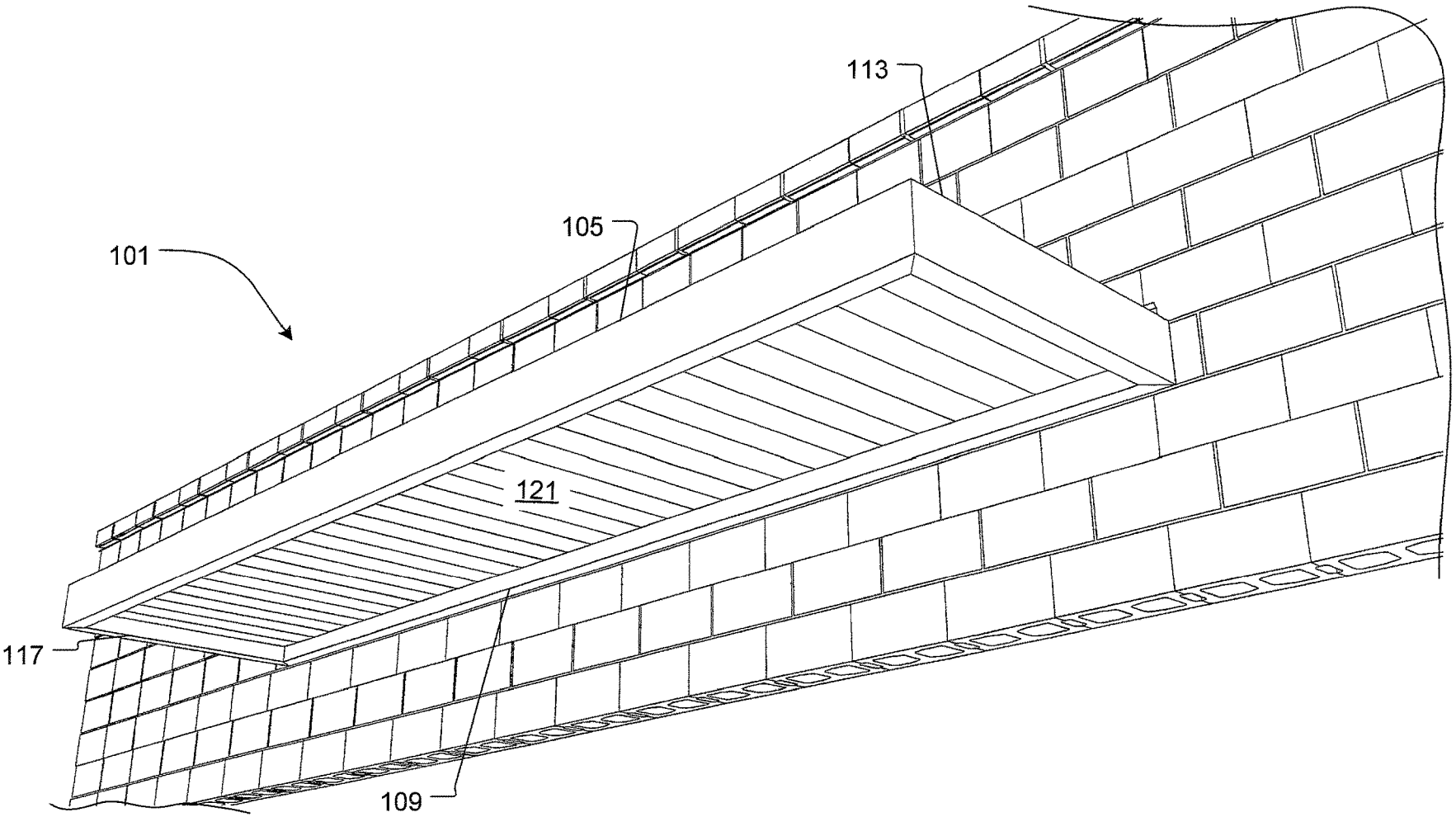
FIG. 1 is a generally downward perspective view of a canopy according to the present application.
Figure 2:
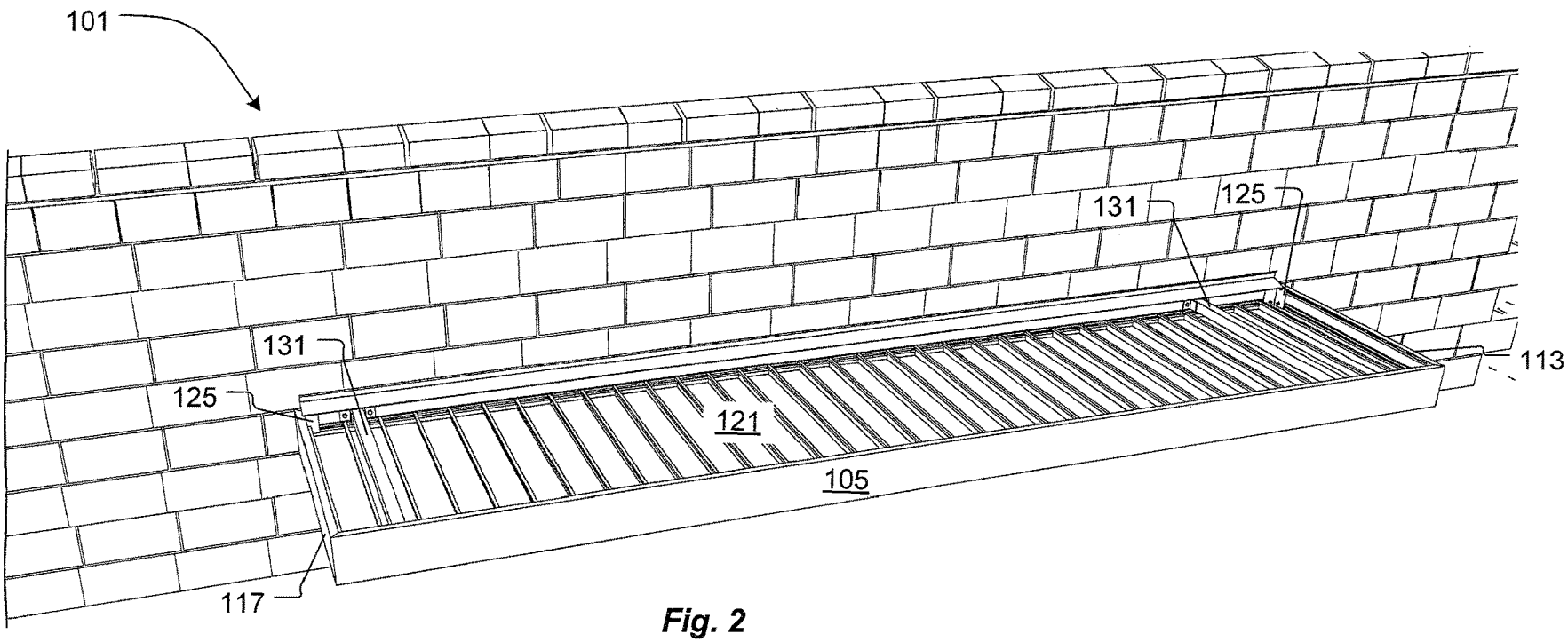
FIG. 2 is a generally upward perspective view of a canopy according to the present application.
Figure 3:
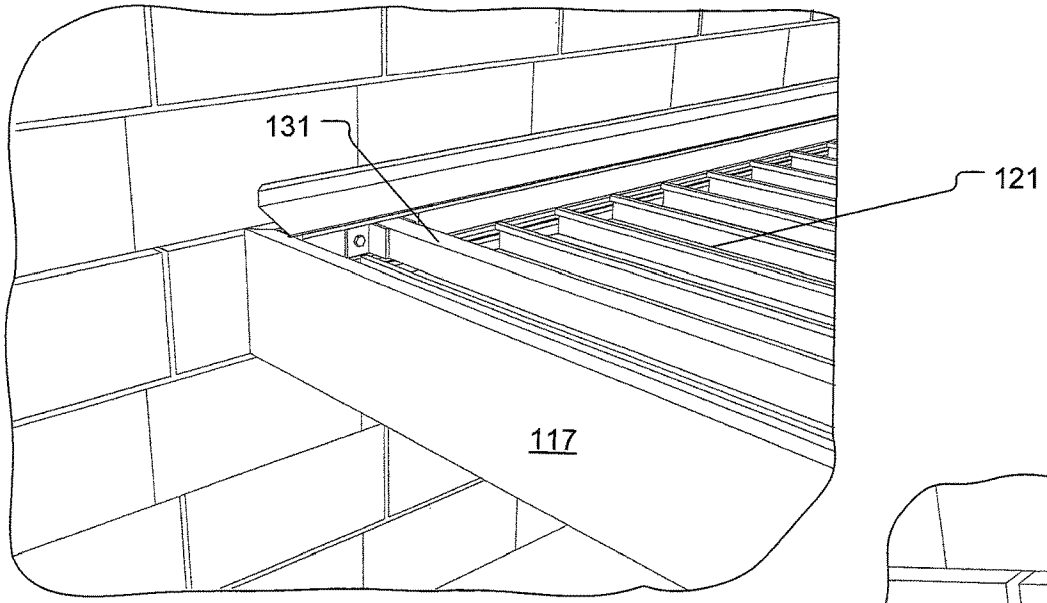
FIG. 3 is a magnified perspective view of the canopy in FIG. 2 according to the present application.
Figure 4:
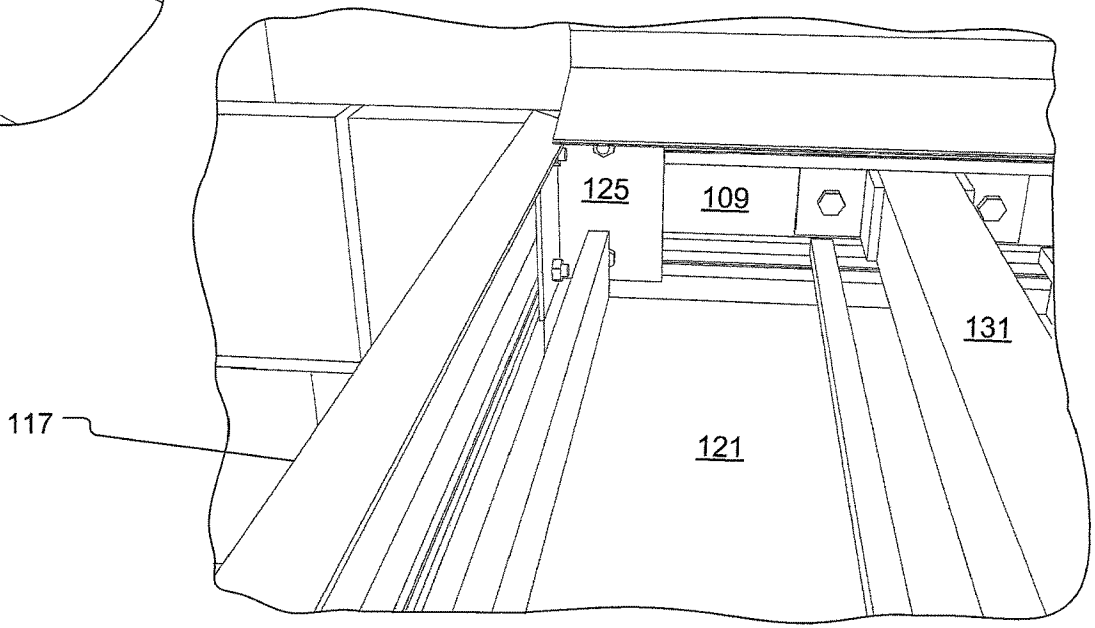
FIG. 4 is a magnified perspective view of the canopy in FIG. 2 according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the extruded aluminum canopy with hidden fasteners system and method are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring now to FIGS. 1-4 in the drawings, a preferred embodiment of a canopy with hidden fasteners according to the present application is illustrated. Canopy 101 is comprised of a front member 105, a back member 109, a first end member 113, a second end member 117, and a deck panel 121. Canopy 101 is installed on the sides of buildings. First the back member 109 is fastened to the surface of the building. First end member 113 and second end member 117 are coupled to the back member by way of brackets 125. Front member 105 is coupled to the first end member 113 and second end member 117 by way of brackets 125 thereby forming a rectangular frame. Deck panel is then sized to fit the canopy, cut to length and width and then coupled to the rectangular frame. Deck panel 121 is typically sized to leave a substantial opening over the gutter portion of the extruded member. Alternatively the deck panel is sized to only leave a small gap above the gutter portion of the extruded member to act as a leaf guard. Deck panel is comprised of interlocked panels and is watertight so that rain falling on the canopy is directed to the extruded members and drained away. Furthermore, braces 131 are installed above the deck. Turnbuckles can be attached from the surface of the building to the braces 131 to further support canopy 101.

Canopy 101 can be cut to length in a shop or in at the installation site because the extruded members are shipped unassembled from the shop to the installation site. Furthermore, because the extruded members can be cut at the site before assembly the parts for the canopy can be adjusted at the site. For example, if the measured length of the canopy needed to be reduced, the back and front extruded members can be precisely cut to reduce the length of the canopy. Conventional welded canopies require a large amount of work to adjust the dimensions of the canopy. Since the canopy is assembled at the installation site, the amount of equipment to hoist the canopy up bit by bit is less than the amount of hoisting equipment needed for conventional welded canopies.

It should be apparent that the canopy 101 does not have fasteners viewable from underneath the canopy. The hidden fasteners of canopy 101 increase the aesthetic appeal of the canopy. Furthermore, the hidden fasteners require less finishing work and over time any corrosion due to a reaction between the fasteners and the extruded members is hidden from view.

Figure 5A:
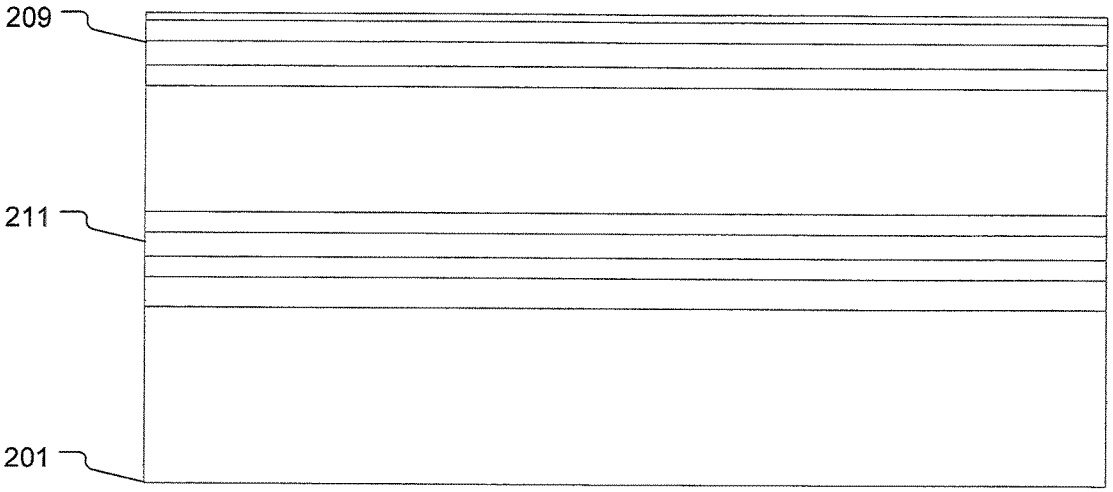
FIG. 5A is a back view of an extruded member according to the present application.
Figure 5C:
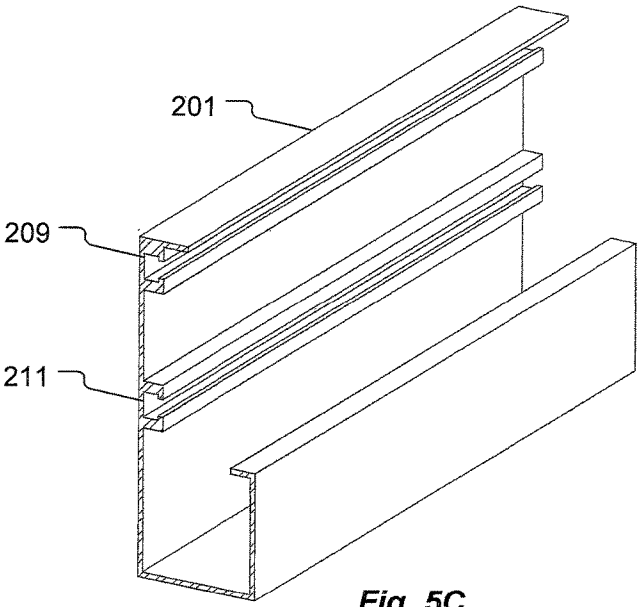
FIG. 5C is a perspective view of an extruded member according to the present application.
Figure 5B:
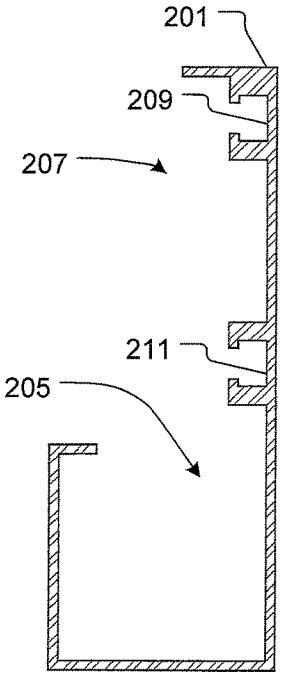
FIG. 5B is an end view of an extruded member according to the present application.

Referring now also to FIG. 5A-5B in the drawings, a preferred embodiment of an extruded member according to the present application is illustrated. Extruded member 201 is comprised of aluminum and extruded into a shape configured for use with hidden fasteners. Extruded member 201 has a gutter portion 205, a tracked portion 207, and a member length. Tracked portion 207 is comprised of at least one track 209 sized to retain a head of a bolt and prevent the bolt from twisting. The head of the bolt can be slid up and down the track however a width of the track is slightly larger than the width of the head of the bolt to prevent the bolt from rotating relative to the track. As illustrated the tracked portion further comprises of a second track 211 sized to retain a head of a bolt and prevent the bolt from twisting. It should be apparent that more tracks are contemplated by this application. Furthermore, while both tracks are illustrated outside the gutter portion 205, it should also be apparent that tracks inside the gutter portion are contemplated by this application. A benefit of locating the tracks in the tracked portion 207 is access to the tracks once the deck panel is attached. Both the first track 209 and the second track 211 run the entire length of the extruded member 201. It should be apparent that escape slots may be located in the tracks to facilitate removal and insertion of fasteners from the extruded member without being at the end of the extruded member. Escape slots are sized that the head of the fastener can be inserted or removed from the middle of the extruded member. Furthermore, there can be a plurality of escape slots located a set distance apart, for example every 1 foot.

Referring now also to FIG. 6A-6D in the drawings, a preferred embodiment of an extruded member corner assembly according to the present application is illustrated. Assembly 301 is comprised of a first extruded member 305, a second extruded member 307, a bracket 311, and a plurality of fasteners 313. The plurality of fasteners is preferably comprised of bolts and nuts. First extruded member 305 is trimmed at a forty-five degree angle at the assembled end. Second extruded member 307 is trimmed at a forty-five degree angle at the assembled end.

Figure 6A:
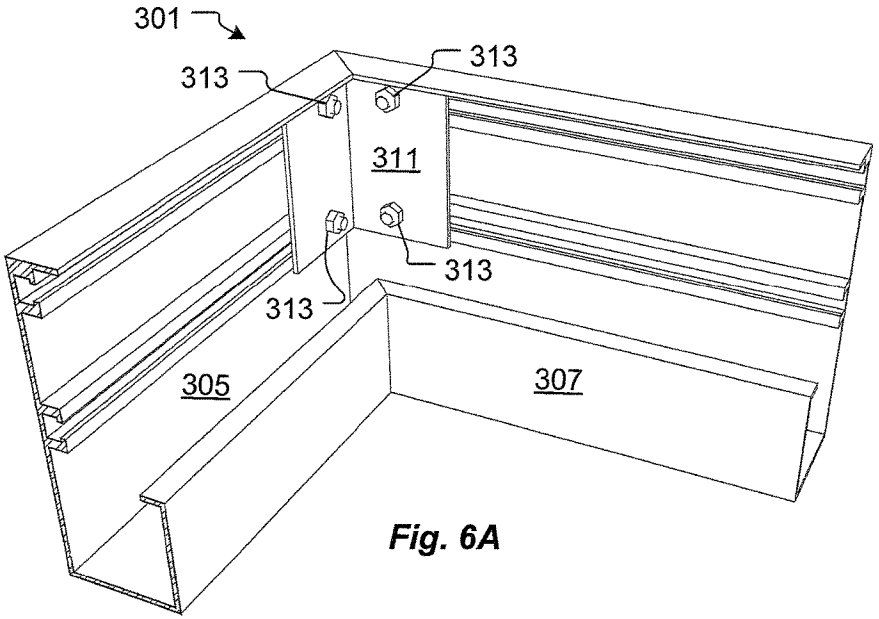
FIG. 6A is a perspective view of the back of an extruded member assembly according to the present application.
Figure 6B:
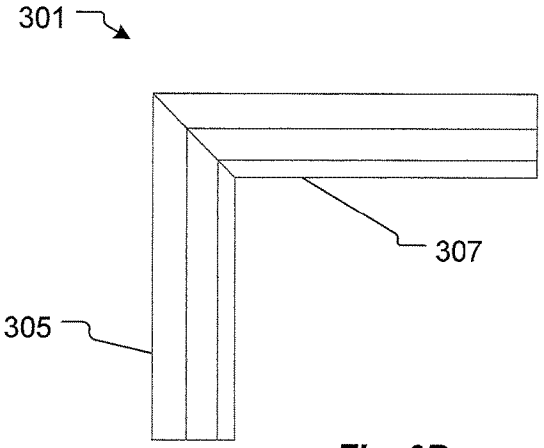
FIG. 6B is a top view of an extruded member assembly according to the present application.
Figure 6C:
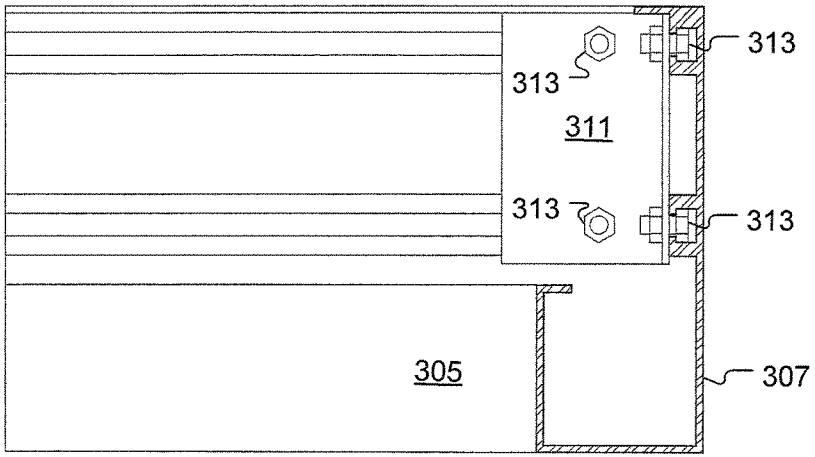
FIG. 6C is an end view of an extruded member assembly according to the present application.
Figure 6D:
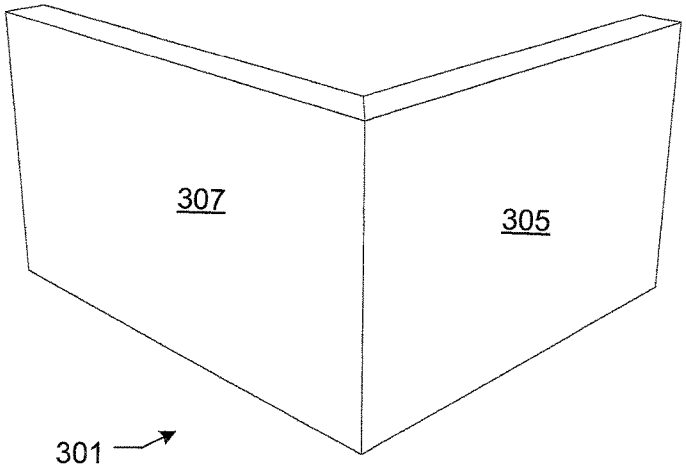
FIG. 6D is a perspective view of the front of an extruded member assembly according to the present application.

To assemble the right angle assembly 301, the head of the bolts are slid into each track of the extruded members. The bracket 311 is then coupled to the bolts and secured by nuts. A colored matched filler, such as epoxy or silicone, is applied between the extruded members to fill any small gaps. Bracket 311 as illustrated is a right angle bracket and thereby forms a right angle assembly. Other shapes and angles are possible based upon the shape of the bracket. The finished corner as shown in FIG. 6D results in a canopy without exposed fasteners viewable from underneath the assembled canopy.

Figure 7B:
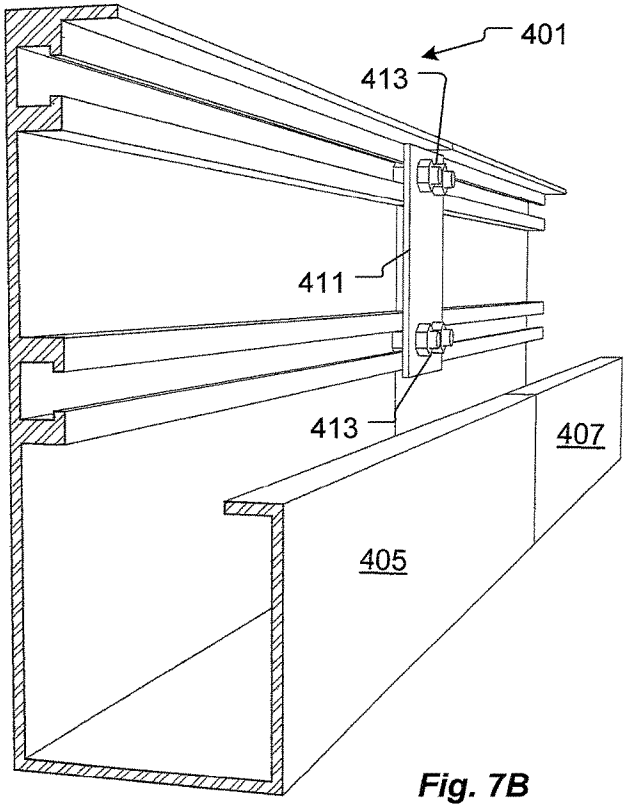
FIGS. 7A and 7B are perspective views of the back of an extruded member assembly according to the present application.
Figure 7A:
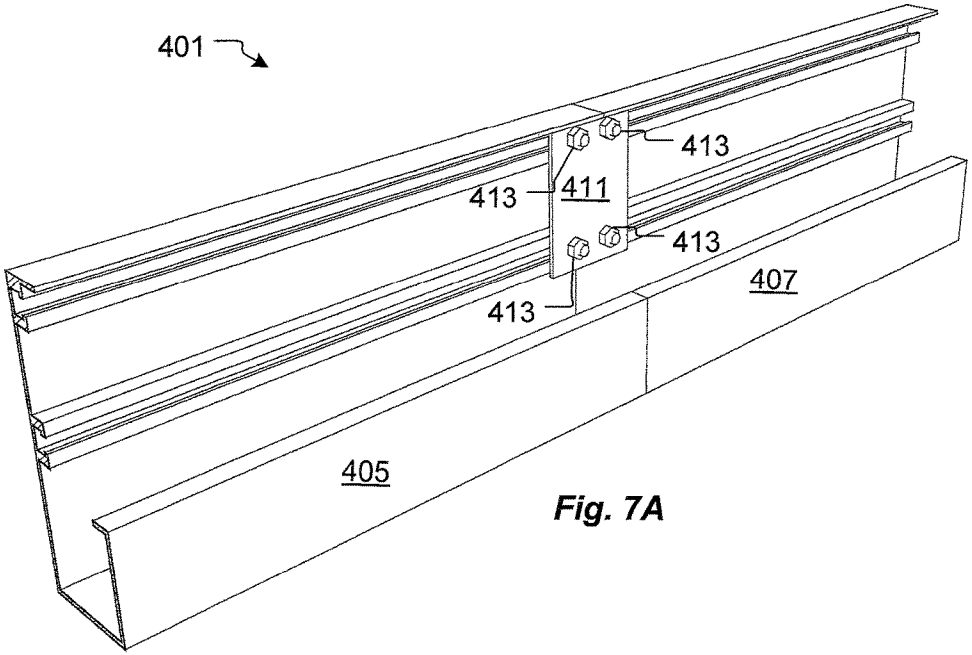

Referring now also to FIG. 7A-7B in the drawings, a preferred embodiment of an extruded member straight assembly according to the present application is illustrated. Straight assembly 401 is comprised of a first extruded member 405, a second extruded member 407, a bracket 411, and a plurality of fasteners 413. The plurality of fasteners is preferably comprised of bolts and nuts. First extruded member 405 is trimmed at a ninety degree angle at the assembled end. Second extruded member 407 is trimmed at a ninety degree angle at the assembled end.

To assemble the assembly 401, the head of the bolts are slid into each track of the extruded members. The bracket 411 is then coupled to the bolts and secured by nuts. A colored matched filler, such as epoxy or silicone, is applied between the extruded members to fill any small gaps. Bracket 411 as illustrated is a straight bracket and thereby forms a straight assembly. Other shapes and angles are possible based upon the shape of the bracket. Assembly 401 allows users to create canopies of various lengths without limitations based upon the length of the extruded members.

It should be apparent that a canopy can comprised of multiple right angle assemblies 301. Furthermore, it should be apparent that multiple right angle assemblies 301 can be joined together by straight assemblies 401 to form a canopy. Additionally, the parts of the canopy can be preassembled at a shop and shipped to the installation site. For example, two right angle assemblies 301 can be formed at a shop, shipped to the installation site, and then combined to form a canopy. Alternatively, four right angle assemblies 401 can be preassembled at the shop, shipped to the installation site, and then combined by assemblies 401 to form a canopy.

The system and method described above solves problems inherent in conventional canopies. First, conventional canopies are welded together and therefore require cutting, welding, sanding, and finishing to repair a damaged canopy. The improved system comprised of extruded members can be disassembled, damaged part replaced, and reassembled without the need to weld, sand, or refinish the canopy. Second, conventional canopies have exposed fasteners viewable from the front and underside of the canopy. The improved system hides the fasteners inside the canopy where they are less visible. Third, conventional systems are assembled and assembled at a shop and then trucked to the installation site, thereby limiting the size of canopy based at least upon the ability to move the conventional welded canopy. The improved system allows a canopy to be shipped unassembled and then assembled at the installation site. Furthermore, it is safer to hoist the canopy a piece at a time instead of a heavier completely assembled canopy.

A method for assembling a canopy having hidden fasteners; providing a first member having at least two tracks; providing a second member having at least two tracks; providing a bracket; providing a first set of fasteners; providing a second set of fasteners; sliding the first set of fasteners into the at least two tracks of the first member; sliding the second set of fasteners into the at least two tracks of the second member; and coupling the first member to the second member with the bracket and both the first set of fasteners and the second set of fasteners. Furthermore, by sizing the at least two tracks of the first member to prevent the first set of fasteners rotating relative to the first member; and by sizing the at least two tracks of the second member to prevent the second set of fasteners rotating relative to the first member the sets of fasteners can be retained by the tracks without the using shims or additional members inside the tracks other than the bolt or fastener. Because the members are not welded together they can be dissembled and reassembled to replace defective members by providing a third member having at least two tracks; uncoupling the first member to the second member with the bracket and both the first set of fasteners and the second set of fasteners; sliding the first set of fasteners out of the at least two tracks of the first member; sliding the first set of fasteners into the at least two tracks of the third member; and coupling the third member to the second member with the bracket and both the first set of fasteners and the second set of fasteners.

Figure 8:
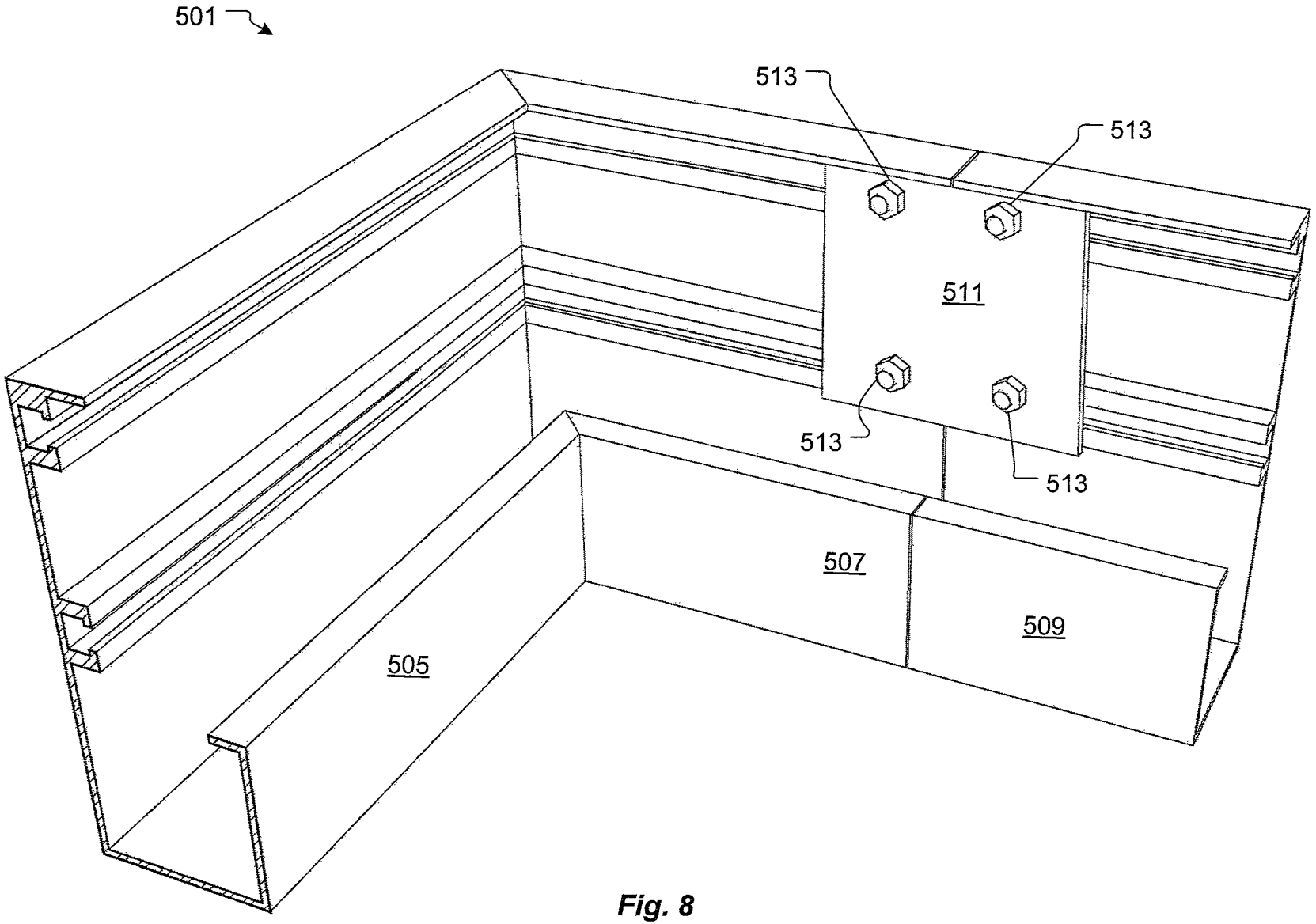
FIG. 8 is a perspective view of the back of an extruded member assembly according to the present application.

Referring now also to FIG. 8 in the drawings, an alternative embodiment of an extruded member corner assembly according to the present application is illustrated. Assembly 501 is comprised of a first extruded member 505, a second extruded member 507, a third extruded member 509, a bracket 511, and a plurality of fasteners 513. The plurality of fasteners is preferably comprised of bolts and nuts. First extruded member 505 is trimmed at a forty-five degree angle at a welded end. Second extruded member 507 is trimmed at a forty-five degree angle at a welded end. First extruded member 505 is welded to second extruded member 507 to form a 90 degree angled corner. Third extruded member 509 is coupled to the welded corner by bracket 511. This embodiment allows a user to fabricate four corners in the shop and take them out to the job site. Once there the straight extruded members can be attached with the hidden fasteners to form a canopy.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A system for extrusion based hidden fastener canopies, comprising:
- a first member, having:
  - at least one T-shaped track, having;
    - a first edge; and
    - a second edge; and
  - an L-shaped gutter;
- a second member, having:
  - at least one T-shaped track;
- a bracket, having:
  - a first hole; and
  - a second hole;
- a first fastener; and
- a second fastener;
- wherein the at least one T-shaped track of the first member is sized to retain the first fastener;
- wherein the first edge of the at least one T-shaped track and the second edge of the at least one T-shaped track are spaced apart to preclude the first fastener from rotating upon placement and while within the at least one T-shaped track; and
- wherein the at least one T-shaped track of the second member is sized to retain the second fastener.

2. The system according to claim 1, wherein the first fastener fastens the first member to the bracket; and
- wherein the second fastener fastens the second member to the bracket.

3. The system according to claim 2, wherein the bracket is right angled.

4. The system according to claim 2, wherein the bracket is straight.

5. The system according to claim 1, wherein the first member and the second member are welded together at a right angle.

6. The system according to claim 5, wherein the first fastener is a first bolt and the second fastener is a second bolt, further comprising:
- a third member having:
  - at least one T-shaped track;
- wherein the first bolt fastens the first member to the bracket; and
- wherein the second bolt fastens the third member to the bracket.

7. The system according to claim 6, wherein the bracket is straight.

8. The system according to claim 1, wherein the first edge of the at least one T-shaped track and the second edge of the at least one T-shaped track are spaced apart to permit sliding the first bolt lengthwise along the T-shaped track.

9. The system according to claim 8, further comprising:
- a nut;
- wherein the nut fastens the bracket to the bolt.

10. The system according to claim 1, wherein the at least one T-shaped track of the first extruded member is disposed outside the L-shaped gutter.

11. The system according to claim 1, wherein the at least one T-shaped track of the second extruded member is disposed outside the L-shaped gutter.

12. The system according to claim 1, wherein the at least one T-shaped track of the second extruded member, comprises:
- a third edge; and
- a fourth edge;
- wherein the third edge and the fourth edge are spaced apart.

13. The system according to claim 12, wherein the third edge of the at least one T-shaped track and the fourth edge of the at least one T-shaped track are spaced apart to preclude the second fastener from rotating upon placement and while within the at least one T-shaped track.

14. A system for extrusion based hidden fastener canopies, comprising:
- an extruded first member, having:
  - at least two T-shaped tracks;
  - wherein the at least two T-shaped tracks of the first extruded member, comprise:
  - first respective edges for each track of the at least two tracks;
  - second respective edges for each track of the at least two tracks;
- an extruded second member, having:
  - at least two T-shaped tracks;
  - wherein the at least two T-shaped tracks of the second extruded member, comprise:
  - third respective edges for each track of the at least two tracks;
  - fourth respective edges for each track of the at least two tracks;
- a bracket;
- a first set of fasteners; and
- a second set of fasteners;
- wherein each of the T-shaped tracks of at least one of the first member are sized to retain the first set of fasteners;
- wherein each of the first respective edges of the at least two T-shaped tracks and the second respective edges of the at least two T-shaped tracks of the first extruded member are spaced apart to preclude the first set of fasteners from rotating upon placement of the first set of fasteners and while the first set of fasteners are within the first and second respective edges of the at least two T-shaped tracks; and
- wherein the first extruded member and the second extruded member are coupled with the bracket and at least one of the first set of fasteners and the second set of fasteners.

15. The system for extrusion based hidden fastener canopies according to claim 14, wherein the first extruded member further comprises:

a first L-shaped gutter.

16. The system for extrusion based hidden fastener canopies according to claim 15, wherein the at least two T-shaped tracks of the first extruded member are outside the first L-shaped gutter.

17. The system for extrusion based hidden fastener canopies according to claim 14, the second extruded member, further comprising:

a second L-shaped gutter.

18. The system for extrusion based hidden fastener canopies according to claim 17, wherein the at least two T-shaped tracks of the second extruded member are outside the second L-shaped gutter.

19. The system for extrusion based hidden fastener canopies according to claim 14, wherein the coupling of the first member to the second member with the bracket is a coupling without welding such that the members and bracket can be disassembled and reassembled.

* * * * *